US005537187A

United States Patent [19]

Sekine

[11] Patent Number: 5,537,187

[45] Date of Patent: Jul. 16, 1996

[54] PROCESS CARTRIDGE HAVING A FRAME CONNECTING MEMBER WITH A GUIDE PORTION, AND IMAGE FORMING APPARATUS USING SAME

[75] Inventor: Kazumi Sekine, Kawasaki, Japan

[73] Assignee: Canon Kabushiki Kaisha, Tokyo, Japan

[21] Appl. No.: 322,469

[22] Filed: Oct. 14, 1994

[30] Foreign Application Priority Data

Oct. 19, 1993 [JP] Japan ..... 5-260542
Oct. 3, 1994 [JP] Japan ..... 6-238882

[51] Int. Cl.[6] ..... G03G 15/00

[52] U.S. Cl. ..... 355/200; 355/210

[58] Field of Search ..... 355/200, 210, 355/211, 245

[56] References Cited

U.S. PATENT DOCUMENTS 5,221,943 6/1993 Hasegawa ..... 355/245
5,287,145 2/1994 Ohtsuka ..... 355/210
5,331,372 7/1994 Tsuda et al. ..... 355/200
5,347,343 9/1994 Ohtsuka et al. ..... 355/200
5,371,575 12/1994 Sekino et al. ..... 355/210
5,406,355 4/1995 Komuro et al. ..... 355/210

FOREIGN PATENT DOCUMENTS

WO-18910 10/1992 Japan .

*Primary Examiner*—William J. Royer
*Attorney, Agent, or Firm*—Fitzpatrick, Cella, Harper & Scinto

[57] ABSTRACT

A process cartridge removably mountable to an image forming apparatus, including an image bearing member, a process unit acting on the image bearing member, a first frame having the image bearing member, a second frame having the process unit, and a connection assembly for connecting the first frame to the second frame. The connection assembly has a guide portion for guiding the process cartridge to a mounting position when the process cartridge is mounted to the image forming apparatus.

32 Claims, 6 Drawing Sheets

PROCESS CARTRIDGE HAVING A FRAME CONNECTING MEMBER WITH A GUIDE PORTION, AND IMAGE FORMING APPARATUS USING SAME

BACKGROUND OF THE INVENTION

1. Field of the Invention

The present invention relates to a process cartridge and an image forming apparatus. The image forming apparatus may be, for example, an electrophotographic copying machine, a laser beam printer, an LED printer, a facsimile system or the like.

2. Related Background Art

In image forming apparatuses such as printers, an image bearing member which was previously uniformly charged is selectively exposed to form a latent image thereon. The latent image is visualized as a toner image which is then transferred onto a recording medium. In such image forming apparatuses, the maintenance of various elements requires an expert service man, and, thus, the user often feels inconvenience.

To avoid this, a process cartridge constituted by assembling an image bearing member, a charger, a developing device, a cleaning device and the like together as a cartridge unit which can be removably mounted to an image forming apparatus by the user has been proposed and put into practical use.

The inventors of this invention have already proposed a new process cartridge (referred to PCT/JP92/00450 filed on Apr. 10, 1992).

The present invention relates to the improvement of such a process cartridge.

SUMMARY OF THE INVENTION

An object of the present invention is to provide a process cartridge and an image forming apparatus, which can improve mounting ability and operability.

Another object of the present invention is to provide a process cartridge and an image forming apparatus, which can improve image quality.

A further object of the present invention is to provide a process cartridge and an image forming apparatus, which can improve assembling ability.

The other object of the present invention is to provide a process cartridge and an image forming apparatus, which can improve operability of the cartridge and recycle rate of the cartridge.

To achieve the above objects, there is provided a process cartridge removably mountable to an image forming apparatus, comprising an image bearing member, a process means acting on the image bearing member, a first frame supporting the image bearing member, a second frame supporting the process means, and a connecting means for connecting the first frame to the second frame, and wherein the connecting means has a guide portion for guiding the process cartridge to a mounting position when the process cartridge is mounted to the image forming apparatus.

With this arrangement, since the connecting means has the guide portion, the assembling ability, operability and mounting ability can be improved.

DETAILED DESCRIPTION OF THE PREFERRED EMBODIMENTS

A process cartridge and an image forming apparatus to which the process cartridge can be removably mounted will now be explained with reference to the accompanying drawings.

Incidentally, an embodiment which will be described hereinbelow relates to an image forming apparatus of electrophotographic type and a process cartridge used with such an image forming apparatus.

Figure 1:
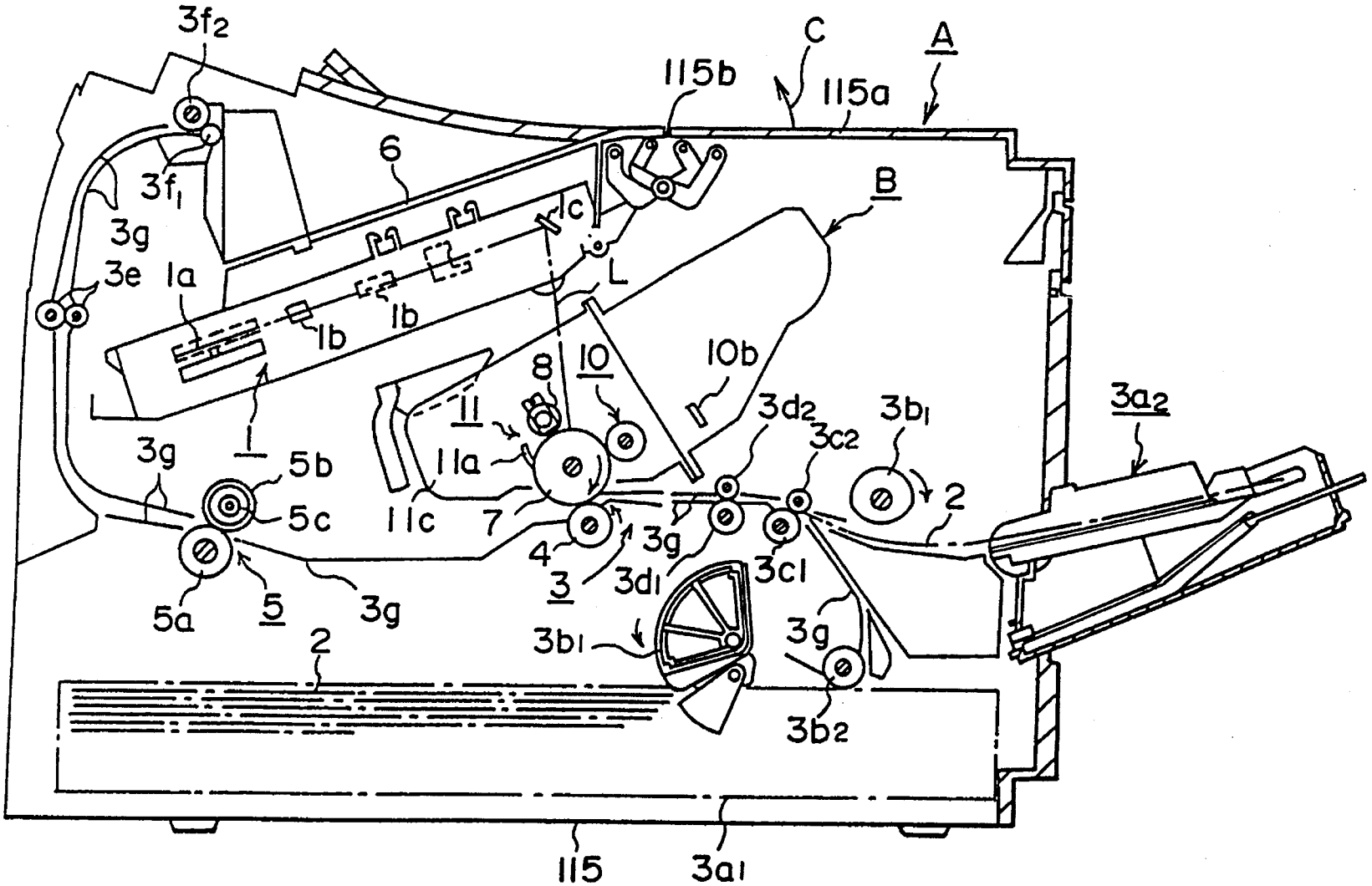
FIG. 1 is an elevational sectional view of an image forming apparatus to which a process cartridge according to a preferred embodiment of the present invention is mounted.
Figure 3:
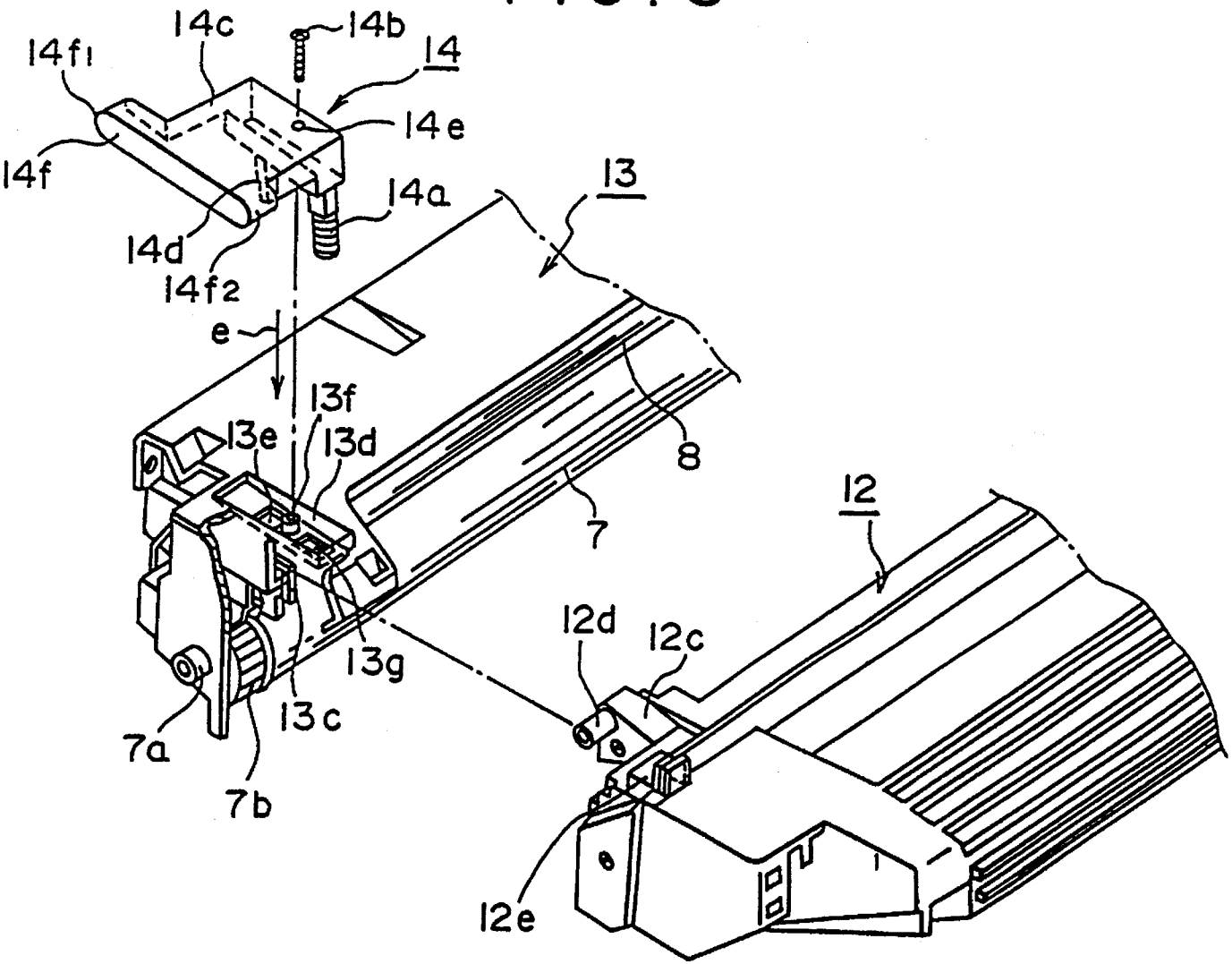
FIG. 3 is a partial exploded perspective view showing a condition where a toner frame and a drum frame are assembled together by connecting members.
Figure 4:
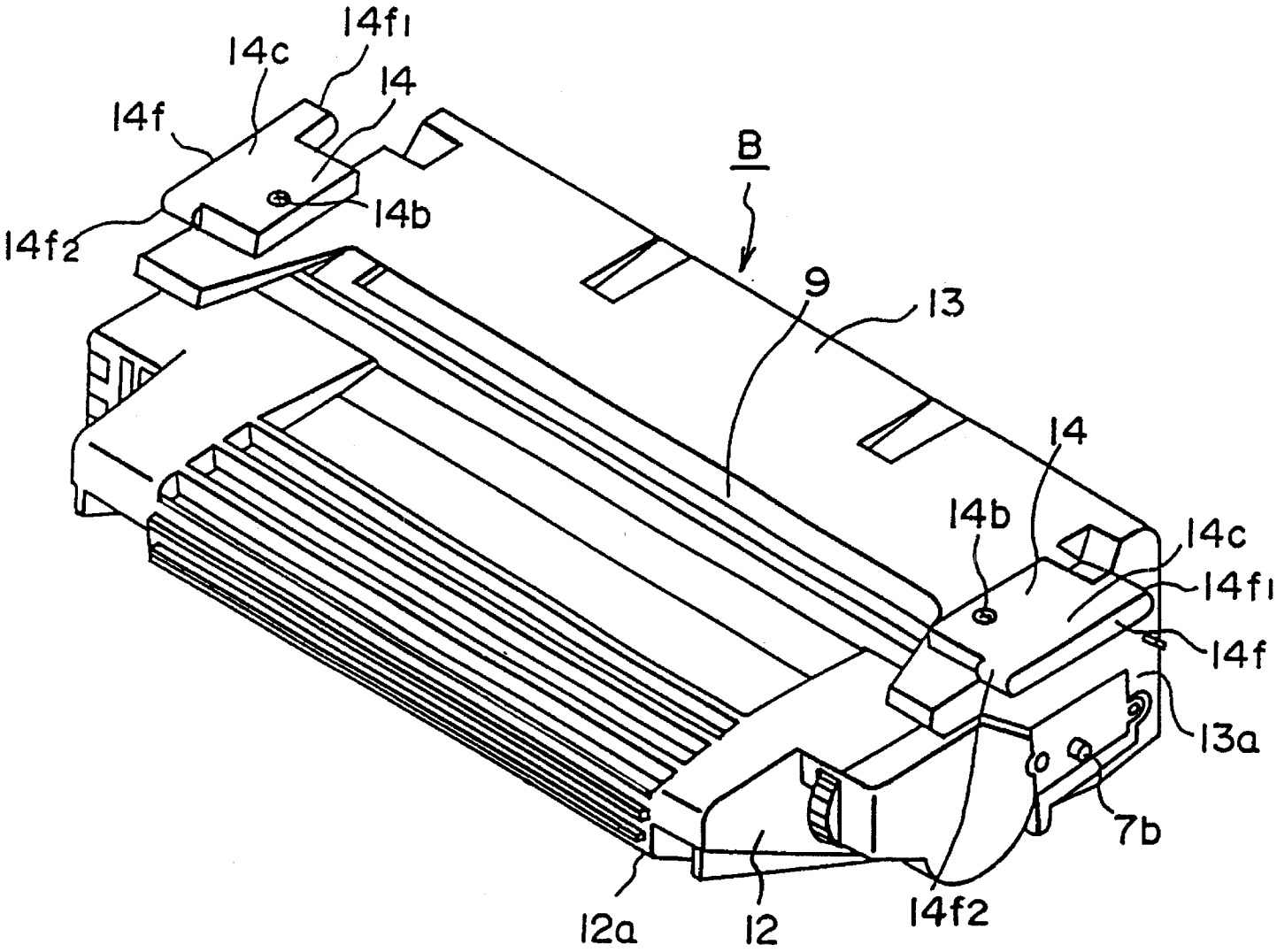
FIG. 4 is a perspective view of the process cartridge.
Figure 5:
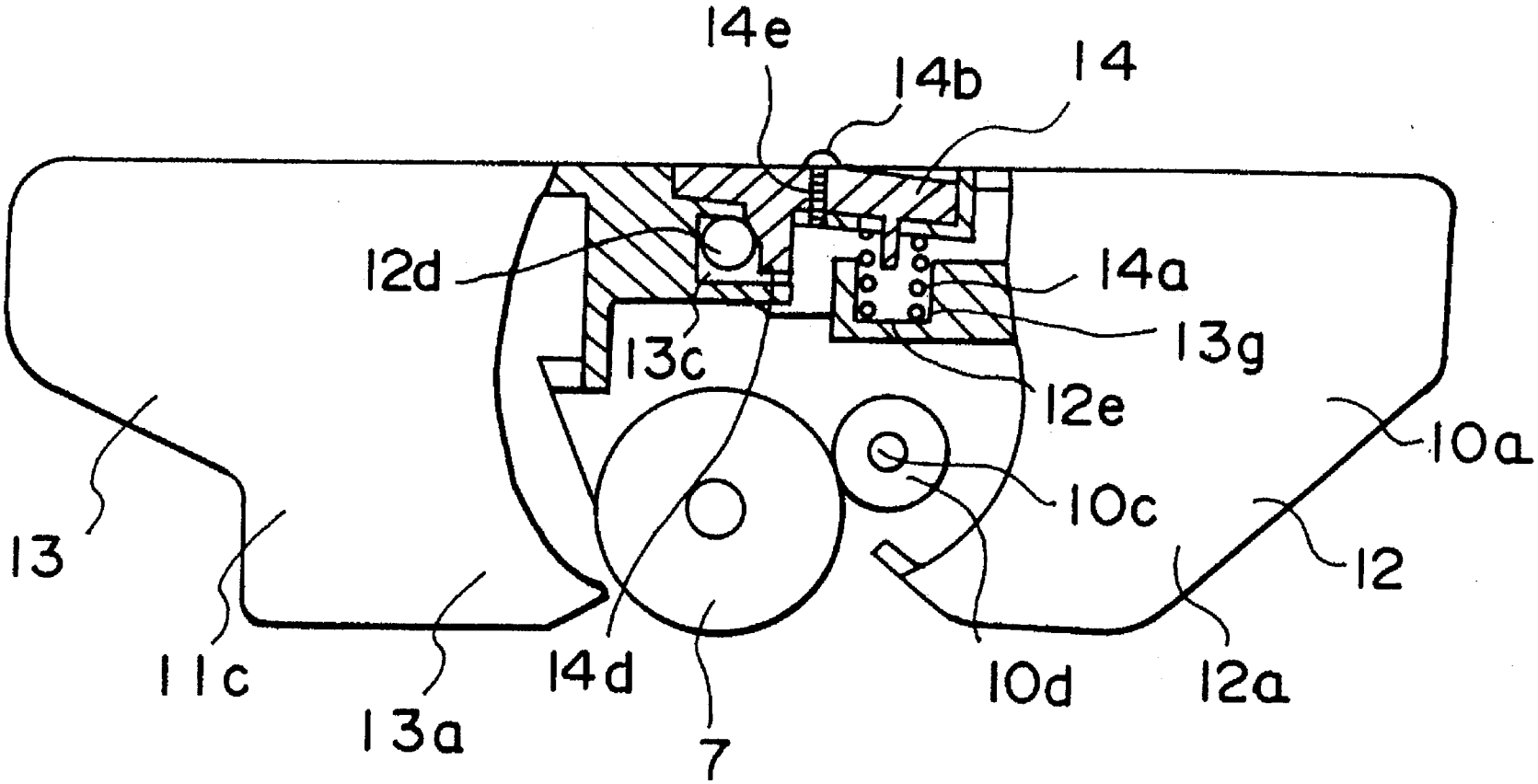
FIG. 5 is a side view, in partial section, of the process cartridge.
Figure 6:
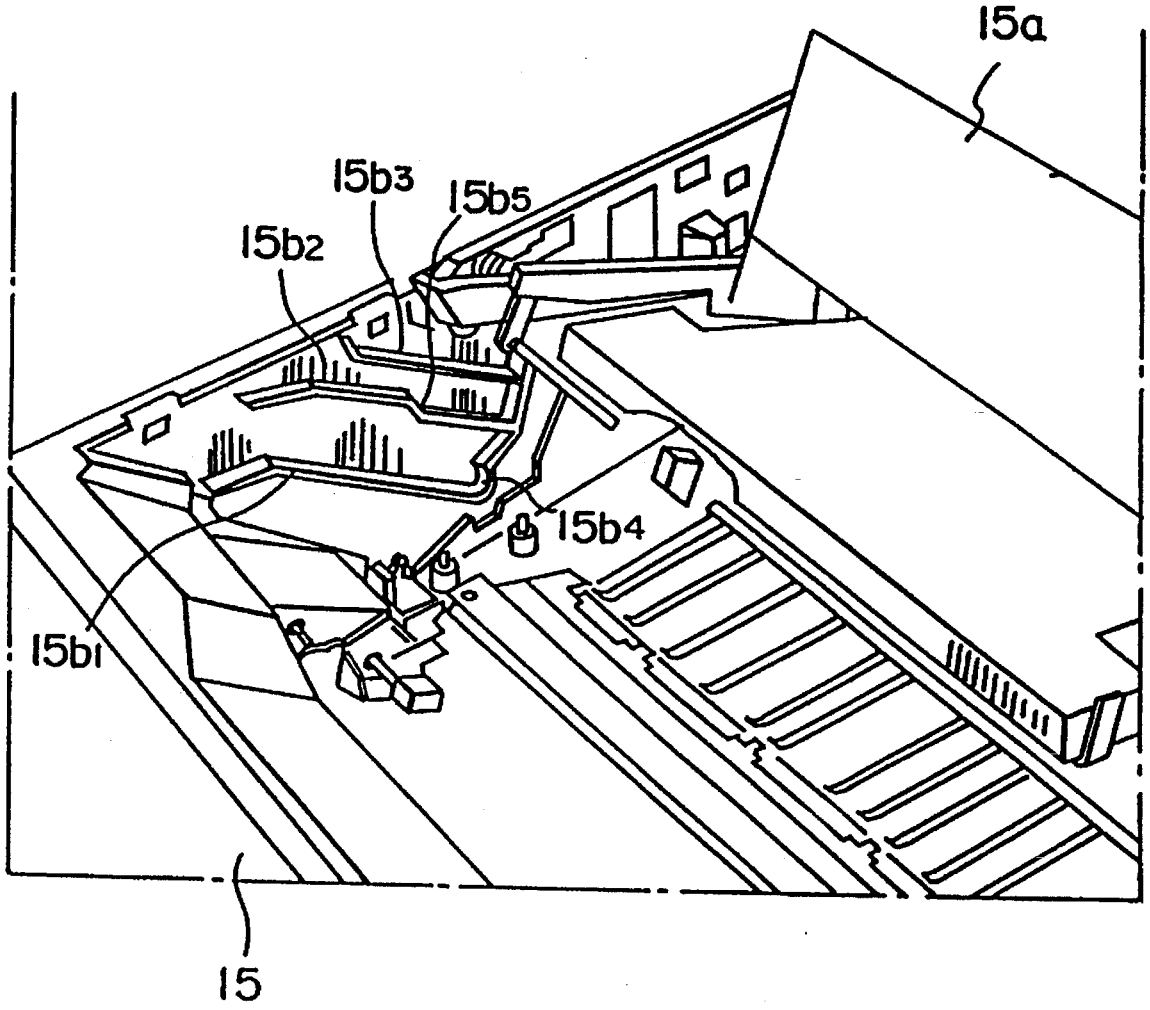
FIG. 6 is a partial perspective view of a cartridge mounting means of the image forming apparatus.

First of all, the entire construction of the process cartridge and the image forming apparatus will be briefly explained. FIG. 1 is an elevational sectional view of an image forming apparatus to which a process cartridge according to a preferred embodiment of the present invention is mounted, FIG. 2 is a cross-sectional view of the process cartridge, FIG. 3 is a partial exploded perspective view showing a condition where a toner frame and a drum frame are assembled together by connecting members, FIG. 4 is a perspective view of the process cartridge, FIG. 5 is a side view, in partial section, of the process cartridge, and FIG. 6 is a partial perspective view of a cartridge mounting means of the image forming apparatus.

As shown in FIG. 1, in the electrophotographic image forming apparatus A, by illuminating light L from an optical system 1 onto an electrophotographic photosensitive drum (image bearing member) in response to image information, an electrostatic latent image is formed on the drum. Then, the latent image is developed with developer (referred to as "toner" hereinafter) to form a toner image. In synchronous with the formation of the toner image, a recording medium 2 is supplied from a cassette **3*a*1 or a supply tray 3*a*2 by a convey means 3 comprising a pick-up roller 3*b*1, a supply roller 3*b*2, a pair of separation rollers 3*c*1, 3*c*2, and a pair of regist rollers 3*d*1, 3*d*2. In an image forming portion defined by a process cartridge B, the toner image formed on the photosensitive drum 7 is transferred onto the recording medium 2 by activating a transfer roller (transfer means) 4. Then, the recording medium is sent to a fixing means 5 comprising a drive roller 5*a* for conveying the recording medium 2 and a driven fixing roller 5*b* having a heater 5*c* therein and urged against the drive roller 5*a*, where the toner image is fixed to the recording medium 2. Thereafter, the recording medium 2 is discharged to a discharge portion 6 through an intermediate roller 3*e* and a pair of discharge rollers 3*f*1, 3*f*2. Various guide members 3*g* for guiding the recording medium 2** are associated with the above-mentioned rollers.

The optical system 1 sends a laser beam to a polygon mirror **1*a* in response to an image signal emitted from an external device such as a host computer. The laser beam reflected from the polygon mirror is incident to the photosensitive drum 7 through a lens 1*b* and a mirror 1*c*. Further, a lid 115***a* is pivotally mounted on a hinge 115*b* to be opened in a direction shown by the arrow C. When the lid 115*a* is opened, the process cartridge B can be mounted to or dismounted from the image forming apparatus.

Figure 2:
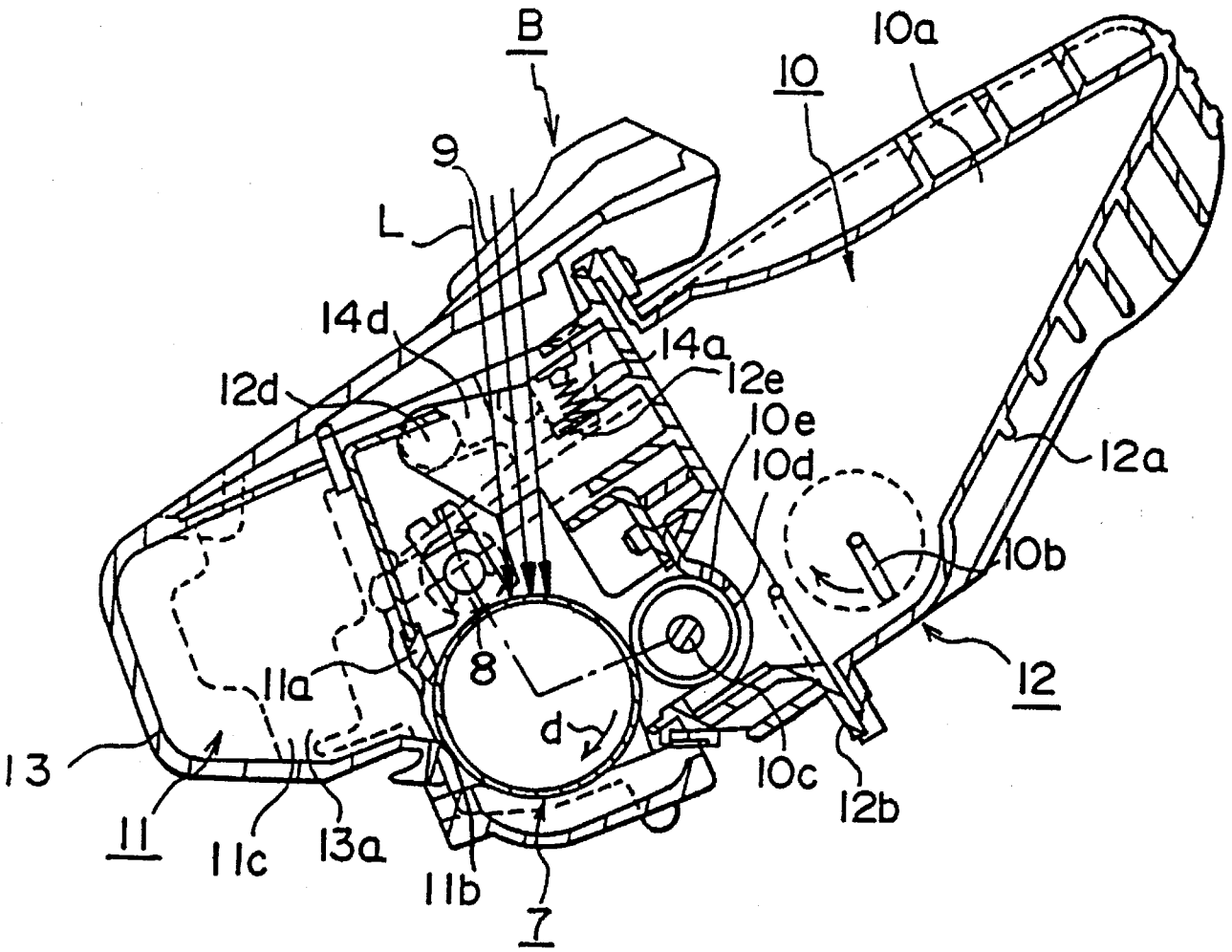
FIG. 2 is a cross-sectional view of the process cartridge.

As shown in FIG. 2, in the process cartridge B defining the image forming portion, the photosensitive drum 7 having an organic photosensitive layer is rotated (in a direction shown by the arrow d), and a surface of the drum is uniformly charged by a charge roller 8 contacted with the drum 7. Then, the light from the optical system 1 corresponding to the image information is incident to the photosensitive drum 7 through an exposure opening 9, thereby forming the latent image. The latent image is developed by a developing device 10 as a toner image. In the developing device 10, the toner contained in a toner reservoir 10*a* is fed out by a toner feed member 10*b* to a rotating developing roller 10*d* having a fixed magnet 10*c* therein, where a toner layer is formed on the developing roller by a developing blade 10*e* due to the friction charging. The toner layer is supplied to the photosensitive drum 7 in synchronous with the latent image, thereby forming the toner image. By applying a voltage having polarity opposite to that of the toner image to the transfer roller 4, the toner image is transferred onto the recording medium 2.

After the transferring operation, the residual toner remaining on the photosensitive drum 7 is removed by an elastic cleaning blade 11*a*. The removed toner is received by a dip sheet 11*b* and then is sent to a waste toner reservoir 11*c*. In this way, the cleaning means 11 can remove the residual toner from the photosensitive drum 7.

Several elements or parts such as the photosensitive drum are contained in a plurality of frames forming a housing. As shown in FIGS. 2 and 3, a toner/development frame 12 comprising a toner frame 12*a* including the toner reservoir 10*a* and the like and a development frame 12*b* including the developing roller 10*d* and the like is connected to a drum frame 13 including the photosensitive drum 7, cleaning means 11 and the like by a connecting member 14, thereby forming the process cartridge B. In the illustrated embodiment, the toner frame 12*a* and the development frame 12*b* are integrally connected to each other by supersonic welding, for instance, thereby forming the toner/development frame 12.

Next, the process cartridge B will be described.

FIGS. 2 to 5 show the process cartridge B according to a preferred embodiment, where FIG. 2 is a side sectional view of the process cartridge, FIG. 3 is a perspective view showing a condition that the toner/development frame 12 is separated from the drum frame 13, FIG. 4 is a perspective view of the process cartridge, and FIG. 5 is a side view, in partial section, showing a condition that the toner/development frame 12 is connected to the drum frame 13.

In the illustrated embodiment, the drum frame 13 is rotatably connected to the toner/development frame 12 to form the process cartridge B. The drum frame 13 has a frame 13*a* for rotatably supporting the photosensitive drum 7 via bearings. The drum frame also supports the cleaning blade 11*a*, the waste toner reservoir 11*c* and the like constituting the cleaning means 11 for cleaning the peripheral surface of the photosensitive drum 7. On the other hand, the toner/development frame 12 has a frame 12*a* for supporting the developing roller 10*d*, the toner reservoir 10*a* and the like constituting the developing device 10. The developing roller 10*d* serves to convey the toner in the toner reservoir 10*a* to a developing station on the photosensitive drum 7.

Next, a method for interconnecting the drum frame 13 and the toner/development frame 12 will be explained.

In the illustrated embodiment, a cylindrical projection 12*d* of the toner/development frame 12 formed on an arm portion 12*c* is fitted into a recess 13*c* formed in the drum frame 13. After the frames 12, 13 are interfitted, a connecting member 14 having a pressure spring (compression spring) 14*a* (connected to the connecting member by snap fit, for example) is fitted into a fitting portion 13*d* disposed above the recess 13*c*. Then, the connecting member 14 is connected to the frame 13 by a screw 14*b* from a direction shown by the arrow e. In this case, the frames 12, 13 are interconnected while regulating the position of the projection 12*d* of the frame 12 by a surface of a vertical plate 14*d* provided on a base 14*c* of the connecting member 14 and the recess 13*c*. The pressure spring 14*a* is received in a spring seat 12*e* of the frame 12, thereby biasing the photosensitive drum 7 and the developing roller 10*d* toward each other.

That is to say, the connecting member 14 has the base 14*c*, a threaded hole 14e formed in the base 14*c*, the vertical plate 14*d* formed on the base 14*c*, and the pressure spring 14*a*.

On the other hand, the fitting portion 13*d* formed in the frame 13 has a recess 13*e* for receiving the vertical plate 14*d*, a female threaded portion 13*f* for receiving the screw 14*b*, and a hole 13*g* through which the spring 14*a* passes.

After the projection 12*d* of the frame 12 is deeply fitted into the recess 13*c* of the frame 13, the connecting member 14 is fitted into the fitting portion 13*d*. That is to say, the vertical plate 14*d* of the connecting member 14 is fitted into the recess 13*e*, the spring 14*a* is passed through the hole 13*g* to be abutted against the spring seat 12*e*, and then the screw 14*b* is threaded into the female threaded portion 13*f*.

As a result, the frames 12, 13 are interconnected for pivotal movement around the projection 12*d*, thereby completing the assembling of the process cartridge B. In the condition that the frames 12, 13 are interconnected, the relative position between the peripheral surface of the photosensitive drum 7 and the peripheral surface of the developing roller 10*d* is determined. Further, due to the biasing force of the compression spring 14*a*, the developing roller 10*d* is urged toward the photosensitive drum 7 (Incidentally, in the illustrated embodiment, the biasing force of the compression spring is set to about 2 kg to apply the urging force of about 1 kg to the developing roller 10*d*).

A drum gear (helical gear) 7*b* arranged at one end of the photosensitive drum 7 is meshed with a development roller gear (not shown) arranged at one end of the developing roller 10*d* so that a rotational driving force from the image forming apparatus can be transmitted to the developing roller 10*d*. As mentioned above, since the frame can be mounted to and dismounted from the frame 13 in the direction of the recess 13*c*, the projection 12*d* can be oriented outwardly (or inwardly), thereby omitting any thrust stopper.

Further, since the connecting member 14 is inserted from the direction e and is fastened along this direction, the positioning of the relative position between the photosensitive drum 7 and the developing roller 10*d* is effected simultaneously with the fastening of the connecting member, thereby eliminating the conventional troublesome attachment of a tension spring. Further, when the process cartridge is disassembled, as the connecting member is unthreaded, the pressure is gradually released. And, since there is no thrust stopper, disassembling operation can be facilitated.

As mentioned above, according to the present invention, since the positioning of the photosensitive drum 7 and the developing roller 10*d* can be effected by using the unit having the compression spring, it is possible to improve the assembling and disassembling ability of the process cartridge.

Incidentally, in the illustrated embodiment, while an example that the drum frame 13 supports the cleaning means was explained, the present invention is not limited to this example, but can be applied to any process cartridge which can be removably mounted to the image forming apparatus in the condition that at least the photosensitive drum and the developing roller are integrally supported.

In the illustrated embodiment, the connecting member 14 has a guide 14*f* for guiding the process cartridge to a mounting position when the process cartridge is mounted to the image forming apparatus. The guide 14*f* is integrally formed on the base 14*c* and extends from one side to the other side at an end of the connecting member opposite to an end where the threaded hole 14*e* is formed. In the condition that the connecting member 14 is fitted into the fitting portion 13*d* of the frame 13, the guide 14*f* is protruded from the frame 13 in a longitudinal direction of the photosensitive drum 7. Thus, when the process cartridge B is mounted to the image forming apparatus A, the guide 14*f* is shifted along guides 1562, 1563 to guide the process cartridge B (inserted from a direction perpendicular to the longitudinal direction of the photosensitive drum) to the mounting position.

Now, the guide will be fully explained.

As mentioned above, the guide portion 14*f* is integrally formed with the connecting member 14. Further, both ends 14*f*1, 14*f*2 of the guide portion 14*f* in the cartridge mounting direction are rounded. When the frames 12, 13 are interconnected by the connecting member 14, as shown in FIG. 4, the guide portions 14*f* are protruded from the process cartridge at both longitudinal ends of the cartridge. Incidentally, each connecting member 14 integrally including the corresponding guide portion 14*f* is made of anti-wear material having good sliding ability to improve the operability of the cartridge (for example, polyacetal, polyamide, polyimide).

The process cartridge B is removably mounted on a cartridge mounting means of the image forming apparatus A. As shown in FIG. 6, the image forming apparatus A has cartridge mounting guide members 15 on both sides thereof. Each of the left and right guide members 15 has a first guide 15*b*1, a second guide 15*b*2, a third guide 15*b*3 and a U-shaped channel 15*b*4 for receiving the process cartridge.

The mounting of the process cartridge B to the image forming apparatus A is effected by opening the lid 115*a* and by inserting the guide portions 14*f* of the connecting members 14 (protruded from both ends of the cartridge) between the guides 15*b*2, 15*b*3 of the cartridge mounting means to be advanced into the apparatus. When the cartridge B is further advanced, the guide portions 14*f* ride over stepped portions 15*b*5 disposed on the guides 15*b*2, and at the same time drum shafts 7*a* and drum bearings 7*b* formed on both longitudinal ends of the cartridge are fitted into the U-shaped channels 15*b*4. In this way, the cartridge B is mounted in position. Then, by closing the lid 115*a*, the process cartridge B is positioned in the image forming apparatus A.

(Other Embodiments)

The present invention is not limited to the process cartridge according to the illustrated embodiment. For example, when a process cartridge having different component of toner and/or different photosensitive drum is manufactured, guide portions suited to such a process cartridge may be integrally formed on corresponding connecting members for interconnecting a plurality of frames constituting the cartridge. In this case, several parts such as the frames can be used in common.

Further, the above-mentioned process cartridge B according to the present invention can be applied to the formation of multi-color image (for example, two-color image, three-color image or full-color image) by providing a plurality of developing devices, as well as the mono-color image formation as mentioned above. Further, the developing method may be the conventional two-component magnet brush developing method, cascade developing method, touch-down developing method, cloud developing method or the like.

Further, in the illustrated embodiment, while the charge means of contact charging type was explained, the charge means for uniformly charging the photosensitive drum may be constituted by covering metal (e.g. aluminium) shields on three walls made of tungsten wires, as is in the conventional technique. In this case, the high voltage is applied to the tungsten wires to generate positive or negative ions which scan the surface of the photosensitive drum, thereby charging the drum.

Incidentally, the charge means may be of blade (charge blade) type, pad type, block type, rod type or wire type, as well as the aforementioned roller type. Further, the cleaning means for removing the residual toner from the drum may be constituted by blade, fur brush, magnet brush or the like.

Further, the process cartridge includes the image bearing member (for example, photoelectric photosensitive body) and at least one of the process means. Accordingly, the process cartridge may incorporate the image bearing member and the charge means therein as an unit which can be removably mounted to the image forming apparatus, or may incorporate the image bearing member and the developing means therein as an unit which can be removably mounted to the image forming apparatus, or may incorporate the image bearing member and the cleaning means therein as a unit which can be removably mounted to the image forming apparatus, or may incorporate the image bearing member and two or more process means therein as an unit which can be removably mounted to the image forming apparatus, as well as the aforementioned one.

That is to say, the process cartridge incorporates the charge means, developing means or cleaning means and the electrophotographic photosensitive body therein as an unit which can be removably mounted to the image forming apparatus, or incorporates at least one of the charge means, developing means and cleaning means, and the electrophotographic photosensitive body therein as an unit which can be removably mounted to the image forming apparatus, or incorporates at least the developing means and the electrophotographic photosensitive body therein as a unit which can be removably mounted to the image forming apparatus.

Further, in the illustrated embodiment, while the laser beam printer was explained as the image forming apparatus, the present invention is not limited to the laser beam printer, but may be applied to other image forming apparatuses such as an electrophotographic copying machine, a facsimile system, a word processor and the like.

As mentioned above, since the guide portion is integrally formed with the connecting member for interconnecting the plurality of frames constituting the process cartridge, even if the guide portion is damaged, the frames can be re-used only by changing the damaged connecting member by a new one, thereby improving the recycle rate of the cartridge and reducing the useless consumption of the resources. Further, since the connecting member is made of anti-wear material having the good sliding ability, the operability and reliability of the process cartridge can be improved.

As mentioned above, according to the present invention, the process cartridge and the image forming apparatus which can improve the mounting ability and the assembling ability are provided.

What is claimed is:

1. A process cartridge removably mountable to an image forming apparatus, said process cartridge comprising:

an electrophotographic photosensitive drum, process means acting on said electrophotographic photosensitive drum, a first frame supporting said electrophotographic photosensitive drum, a second frame supporting said process means, and connecting means for connecting said first frame and said second frame, said connecting means including guide portion means for guiding the process cartridge to a mounting position when the process cartridge is mounted to the image forming apparatus.

2. A process cartridge according to claim 1, wherein said connecting means has a base, a spring one end of which is attached to said base, and an engagement member protruded from said base, said engagement member engaging a rotary shaft of said second frame with said first frame.

3. A process cartridge according to claim 2, wherein said process means in said second frame is a developing roller, and wherein said spring applies an elastic force to said first and second frame so that said electrophotographic photosensitive drum and said developing roller are biased toward each other.

4. A process cartridge according to claim 2 or 3, wherein said spring is a compression spring.

5. A process cartridge according to any one of claims 1 to 3, wherein said guide portion means of said connecting means is protruded from said first frame in an axial direction of said electrophotographic photosensitive drum and serves to guide the process cartridge mounted to the image forming apparatus along a direction perpendicular to said axial direction.

6. A process cartridge according to any one of claims 1 to 3, wherein said connecting means is removably attached to an upper surface of said first frame.

7. A process cartridge according to claim 1, wherein the process cartridge incorporates developing means as said process means, and said electrophotographic photosensitive drum as a unit which can be removably mounted to the image forming apparatus.

8. A process cartridge according to claim 1, wherein the process cartridge incorporates at least a developing means as said process means, and said electrophotographic photosensitive drum as a unit which can be removably mounted to the image forming apparatus.

9. A process cartridge removably mountable to an electrophotographic image forming apparatus, said process cartridge comprising:

an electrophotographic photosensitive drum, a developing roller for supplying developer to said electrophotographic photosensitive drum to develop a latent image formed on said electrophotographic photosensitive drum, a first frame supporting said electrophotographic photosensitive drum, a second frame supporting said developing roller, and connecting means for rotatably connecting said first frame and said second frame so that an elastic force is applied to urge said electrophotographic photosensitive drum of said first frame and said developing roller of said second frame toward each other, said connecting means including guide portion means for guiding the process cartridge to a mounting position when the process cartridge is mounted to the image forming apparatus.

10. A process cartridge according to claim 9, wherein said connecting means has a base, a spring one end of which is attached to said base, and an engagement member protruded from said base, said engagement member engaging a rotary shaft included in said second frame with said first frame, and said spring applies the elastic force to said first and second frames to urge said electrophotographic photosensitive drum and said developing roller toward each other.

11. A process cartridge according to claim 10, wherein said spring is a compression spring.

12. A process cartridge according to claim 9 or 10, wherein said guide portion means of said connecting means is protruded from said first frame in an axial direction of said electrophotographic photosensitive drum and serves to guide the process cartridge mounted to the image forming apparatus along a direction perpendicular to said axial direction.

13. A process cartridge according to any one of claims 9 to 11, wherein said connecting means is removably attached to an upper surface of said first frame.

14. A process cartridge according to claim 9, wherein said first frame further has a contact charge roller for charging said electrophotographic photosensitve drum.

15. A process cartridge according to claim 9 or 14, wherein said first frame further has a cleaning blade for removing residual developer remaining on said electrophotographic photosensitive drum.

16. A process cartridge according to claim 9, wherein said second frame further has a developer containing portion for containing developer to be supplied to said developing roller.

17. A process cartridge removably mountable to an electrophotographic image forming apparatus, said process cartridge comprising:

an electrophotographic photosensitive drum, a developing roller for supplying developer to said electrophotographic photosensitive drum to develop a latent image formed on said electrophotographic photosensitive drum, a first frame supporting said electrophotographic photosensitive drum, a second frame supporting said developing roller, and connecting means for rotatably connecting said first frame and said second frame so that an elastic force is applied to urge said electrophotographic photosensitive drum of said first frame and said developing roller of said second frame toward each other, said connecting means comprising a compression spring providing the elastic force, a connecting member for rotatably connecting said first frame and said second frame, and a guide portion for guiding the process cartridge to a mounting position when the process cartridge is mounted to the image forming apparatus, said guide portion protruding from said first frame outwardly in an axial direction of said electrophotographic photosensitive drum to guide the process cartridge mounted to the image forming apparatus along a direction perpendicular to said axial direction.

18. A process cartridge according to claim 17, wherein said connecting means is removably attached to an upper surface of said first frame.

19. A process cartridge according to claim 17 or 18, wherein said first frame further has a contact charge roller for charging said electrophotographic photosensitive drum.

20. A process cartridge according to either claim 17 or claim 18, wherein said first frame further has a cleaning blade for removing residual developer remaining on said electrophotographic photosensitive drum.

21. A process cartridge according to claim 20, wherein said second frame further has a developer containing portion for containing developer to be supplied to said developing roller.

22. An image forming apparatus to which a process cartridge can be mounted to form an image on a recording medium, comprising:

(a) mounting means capable of mounting a process cartridge including an electrophotographic photosensitive drum, a process means acting on said electrophotographic photosensitive drum, a first frame having said electrophotographic photosensitive drum, a second frame having said process means, and a connecting means for connecting said first frame and said second frame, and said connecting means having a guide portion means for guiding the process cartridge to a mounting position when the process cartridge is mounted to the image forming apparatus;

(b) guide means adapted to be abutted against said guide portion means of said connecting means to guide the process cartridge to said mounting position;

(c) transfer means for transferring a toner image formed on said electrophotographic photosensitive drum of said process cartridge onto a recording medium;

(d) fixing means for fixing the toner image transferred to the recording medium onto said recording medium; and (e) convey means for conveying the recording medium.

23. An image forming apparatus according to claim 22, wherein said transfer means is a transfer roller.

24. An image forming apparatus to which a process cartridge can be mounted to form an image on a recording medium, comprising:

(a) mounting means capable of mounting a process cartridge including an electrophotographic photosensitive drum, a developing roller for supplying developer to said electrophotographic photosensitive drum to develop a latent image formed on said electrophotographic photosensitive drum, a first frame having said electrophotographic photosensitive drum a second frame having said developing roller, and connecting means for rotatably connecting said first frame and said second frame so that an elastic force is applied to urge said electrophotographic photosensitive drum supported by said first frame and said developing roller supported by said second frame toward each other, and said connecting means having a guide portion means for guiding the process cartridge to a mounting position when the process cartridge is mounted to the image forming apparatus;

(b) guide means adapted to be abutted against said guide portion means of said connecting means to guide the process cartridge to said mounting position;

(c) transfer means for transferring a toner image formed on said electrophotographic photosensitive drum of said process cartridge onto a recording medium;

(d) fixing means for fixing the toner image transferred to the recording medium onto said recording medium; and (e) convey means for conveying the recording medium.

25. An image forming apparatus according to claim 24, wherein said transfer means is a transfer roller.

26. An image forming apparatus to which a process cartridge can be mounted to form an image on a recording medium, comprising:

(a) mounting means capable of mounting a process cartridge including an electrophotographic photosensitive drum, a developing roller for supplying developer to said electrophotographic photosensitive drum to develop a latent image formed on said electrophotographic photosensitive drum, a first frame having said electrophotographic photosensitive drum, a second frame having said developing roller, and a connecting means for rotatably connecting said first frame and said second frame so that an elastic force is applied to urge said electrophotographic photosensitive drum supported by said first frame and said developing roller supported by said second frame toward each other, said connecting means comprising a compression spring providing the elastic force, and a connecting member for rotatably connecting said first frame and said second frame, wherein said connecting means has a guide portion for guiding the process cartridge to a mounting position when the process cartridge is mounted to the image forming apparatus, said guide portion being protuded from said first frame outwardly in an axial direction of said electrophotographic photosensitive drum and serving to guide the process cartridge mounted to the image forming apparatus along a direction perpendicular to said axial direction;

(b) guide means adapted to be abutted against said guide portion means of said connecting means to guide the process cartridge to said mounting position;

(c) transfer means for transferring a toner image formed on said electrophotographic photosensitive drum of said process cartridge onto a recording medium;

(d) fixing means for fixing the toner image transferring to the recording medium onto said recording medium; and (e) convey means for conveying the recording medium.

27. An image forming apparatus according to claim 26, wherein said transfer means is a transfer roller.

28. A process cartridge removably mountable to an electrophotographic image forming apparatus, said process cartridge comprising:

an electrophotographic photosensitive drum, a developing roller for supplying developer to said electrophotographic photosensitive drum to develop a latent image formed on said electrophotographic photosensitive drum, a first frame supporting said electrophotographic photosensitive drum, said first frame including a charge roller abutting said electrophotographic photosensitive drum for charging said drum and a cleaning blade abutting said electrophotographic photosensitive drum for removing residual toner remaining thereon, a second frame supporting said developing roller, and a connection assembly for rotatably connecting said first frame and second frame so that an elastic force is applied to urge said electrophotographic photosensitive drum of said first frame and said developing roller of said second frame toward each other, said connection assembly comprising a compression spring providing the elastic force, a connecting member for rotatably connecting said first frame and said second frame, and a guide portion for guiding the process cartridge to a mounting position when the process cartridge is mounted to the image forming apparatus, said guide portion protruding from said first frame outwardly in an axial direction of said electrophotographic photosensitive drum to guide the process cartridge mounted to the image forming apparatus along a direction perpendicular to the axial direction.

29. A process cartridge according to claim 28, wherein said connection assembly is removably attached to an upper surface of said first frame.

30. A process cartridge according to claim 28, wherein said second frame further has a developer containing portion for containing developer to be supplied to said developing roller.

31. An image forming apparatus to which a process cartridge can be mounted to form an image on a recording medium comprising:

(a) a mounting device capable of mounting a process cartridge including an electrophotographic photosensitive drum, a developing roller for supplying developer to said electrophotographic photosensitive drum to develop a latent image formed on said electrophotographic photosensitive drum, a first frame having said electrophotographic photosensitive drum, wherein said first frame also has a charge roller abutting said electrophotographic photosensitive drum for charging said drum and a cleaning blade abutting said electrophotographic photosensitive drum for removing residual toner remaining thereon, a second frame having said developing roller, and a connection assembly for rotatably connecting said first frame and second frame so that an elastic force is applied to urge said electrophotographic photosensitive drum of said first frame and said developing roller of said second frame toward each other, said connection assembly comprising a compression spring providing the elastic force, a connecting member for rotatably connecting said first frame and said second frame, and a guide portion for guiding the process cartridge to a mounting position when the process cartridge is mounted to the image forming apparatus;

(b) a guide member adapted to be abutted against said guide portion of said connection assembly to guide the process cartridge to the mounting position;

(c) a transfer unit that transfers a toner image formed on said electrophotographic photosensitive drum to the recording medium;

(d) a fixing unit that fixes the toner image transferred to the recording medium onto the recording medium; and (e) a conveying unit that conveys the recording medium.

32. An image forming apparatus according to claim 31, wherein said transfer unit comprises a transfer roller.

* * * * *

UNITED STATES PATENT AND TRADEMARK OFFICE

CERTIFICATE OF CORRECTION

PATENT NO. : 5,537,187

DATED : July 16, 1996

INVENTOR(S) : KAZUMI SEKINE

It is certified that error appears in the above-indentified patent and that said Letters Patent is hereby corrected as shown below:

COLUMN 2

Line 44, change "In synchronous" to --Synchronous--.

COLUMN 3

Line 19, change "in synchronous" to --synchronously--.

COLUMN 4

Line 39, change "(Incidentally," to --(incidentally,--.

COLUMN 5

Line 22, change "1562,1563" to --15b2, 15b3--; and

Line 61, change "having" to --having a--.

COLUMN 6

Line 3, change "of" to --of a--; and

Line 62, change "by" to --for--.

UNITED STATES PATENT AND TRADEMARK OFFICE

CERTIFICATE OF CORRECTION

PATENT NO. : 5,537,187 Page 2 of 2

DATED : July 16, 1996

INVENTOR(S) : KAZUMI SEKINE

It is certified that error appears in the above-indentified patent and that said Letters Patent is hereby corrected as shown below:

COLUMN 9

Line 47, change "drum" to --drum,--.

COLUMN 10

Line 26, change "protuded" to --protruded--.

Signed and Sealed this

Twelfth Day of November, 1996

*Attest:*

Bruce Lehman

BRUCE LEHMAN

*Attesting Officer*

*Commissioner of Patents and Trademarks*